US009727017B2

(12) United States Patent
Sunohara

(10) Patent No.: US 9,727,017 B2
(45) Date of Patent: Aug. 8, 2017

(54) MEDIUM TRANSPORTATION APPARATUS, IMAGE FORMING APPARATUS, AND METHOD OF ASSEMBLING MEDIUM TRANSPORTATION APPARATUS

(71) Applicant: OKI DATA CORPORATION, Tokyo (JP)

(72) Inventor: Takahiro Sunohara, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/695,136

(22) Filed: Apr. 24, 2015

(65) Prior Publication Data

US 2015/0309462 A1 Oct. 29, 2015

(30) Foreign Application Priority Data

Apr. 25, 2014 (JP) ..... 2014-091334

(51) Int. Cl.

| | |
|---|---|
| ***B65H 85/00*** | (2006.01) |
| ***G03G 15/00*** | (2006.01) |
| ***B65H 5/00*** | (2006.01) |
| ***B65H 5/06*** | (2006.01) |
| ***B65H 5/26*** | (2006.01) |
| ***G03G 21/16*** | (2006.01) |
| *G03G 15/23* | (2006.01) |

(52) U.S. Cl.

CPC ..... *G03G 15/6529* (2013.01); *B65H 5/00* (2013.01); *B65H 5/062* (2013.01); *B65H 5/068* (2013.01); *B65H 5/26* (2013.01); *B65H 85/00* (2013.01); *G03G 21/1695* (2013.01); *G03G 15/234* (2013.01); *G03G 2215/00438* (2013.01); *G03G 2215/00675* (2013.01)

(58) Field of Classification Search

CPC ..... B65H 85/00; B65H 5/062; B65H 5/068; G03G 15/234; G03G 15/6579; G03G 21/1609; G03G 21/1695; B41J 3/60

See application file for complete search history.

(56) References Cited

U.S. PATENT DOCUMENTS

| | | | | |
|---|---|---|---|---|
| 9,156,635 | B2 * | 10/2015 | Nguyen | B65H 85/00 |
| 2012/0228816 | A1 * | 9/2012 | Tomatsu | B41J 3/60 271/3.19 |
| 2014/0210159 | A1 * | 7/2014 | Kobayashi | B65H 5/062 271/226 |

FOREIGN PATENT DOCUMENTS

| | | | |
|---|---|---|---|
| JP | 2006008340 | A * | 1/2006 |
| JP | 2012-093648 | A | 5/2012 |

* cited by examiner

*Primary Examiner* — Luis A Gonzalez

(74) *Attorney, Agent, or Firm* — Kubotera & Associates, LLC

(57) ABSTRACT

A medium transportation apparatus includes a transportation portion for transporting a medium; a first structure unit for forming a first transportation path to guide and transport the medium in a first direction from an upstream side in a medium transportation direction toward a downstream side in the medium transportation direction; and a second structure unit for forming an accommodation space to accommodate a part of the first structure unit. The first structure unit includes a first region disposed outside the accommodation space on the downstream side in the medium transportation direction and a second region disposed inside the accommodation space on the upstream side in the medium transportation direction.

8 Claims, 9 Drawing Sheets

MEDIUM TRANSPORTATION APPARATUS, IMAGE FORMING APPARATUS, AND METHOD OF ASSEMBLING MEDIUM TRANSPORTATION APPARATUS

BACKGROUND OF THE INVENTION AND RELATED ART STATEMENT

The present invention relates to a medium transportation apparatus for transporting a medium such as a sheet and the like, an image forming apparatus including the medium transportation apparatus, and a method of assembling the medium transportation apparatus.

When a conventional image forming apparatus forms images on both side surfaces of a medium, an image forming portion of the conventional image forming apparatus forms a first image on one side surface of the medium transported thereto. Consequently, a front side surface and a backside surface of the medium are reversed at a medium reversing transportation path (a sheet reversing transportation path), and the medium is returned to a location in front of the image forming portion. In the next step, the image forming portion forms a second image on the other side surface of the medium (refer to, for example, Patent Reference).

Patent Reference: Japanese Patent Publication No. 2012-93648

In the conventional image forming apparatus disclosed in Patent Reference, the medium reversing transportation path is formed of a guide member attached to a main body structural portion of the conventional image forming apparatus. The medium reversing transportation path is configured as a transportation path for returning the medium to the location in front of the image forming portion after the image forming portion forms the first image on the medium. Accordingly, it is necessary to adjust a length of the guide member constituting the medium reversing transportation path in a horizontal direction according to a length of the image forming portion in a medium transportation direction.

For example, when the conventional image forming apparatus is a monochrome image forming apparatus having the image forming portion formed of one image forming cartridge for forming a monochrome image, it is necessary to use the guide member constituting the medium reversing transportation path and having a short length in the horizontal direction in parallel to the medium transportation direction. On the other hand, when the conventional image forming apparatus is a color image forming apparatus having the image forming portion formed of a plurality of image forming cartridges for forming a color image, the image forming portion has a length in the medium transportation direction greater than that of the image forming portion formed of one image forming cartridge for forming a monochrome image. Accordingly, it is necessary to use the guide member constituting the medium reversing transportation path and having a long length in the horizontal direction in parallel to the medium transportation direction.

Accordingly, when the two types of the conventional image forming apparatus, i.e., the monochrome image forming apparatus and the color image forming apparatus, are manufactured, it is necessary to separately prepare the two types of the guide members, i.e., the relatively short guide member for the monochrome image forming apparatus and the relatively long guide member for the color image forming apparatus. As a result, it is difficult to communize the guide members, that is, a main component constituting the medium reversing transportation path.

In order to solve the problems of the conventional image forming apparatus described above, an object of the present invention is to provide a medium transportation apparatus capable of communizing a main component constituting a medium reversing transportation path, an image forming apparatus including the medium transportation apparatus, and a method of assembling the medium transportation apparatus.

Further objects and advantages of the invention will be apparent from the following description of the invention.

SUMMARY OF THE INVENTION

In order to attain the objects described above, according to a first aspect of the present invention, a medium transportation apparatus includes a transportation portion for transporting a medium; a first structure unit for forming a first transportation path to guide and transport the medium in a first direction from an upstream side in a medium transportation direction toward a downstream side in the medium transportation direction; and a second structure unit for forming an accommodation space to accommodate a part of the first structure unit. The first structure unit includes a first region disposed outside the accommodation space on the downstream side in the medium transportation direction and a second region disposed inside the accommodation space on the upstream side in the medium transportation direction.

According to a second aspect of the present invention, an image forming apparatus includes the medium transportation apparatus in the first aspect of the present invention.

According to a third aspect of the present invention, a method is for assembling a medium transportation apparatus inside an image forming apparatus. The medium transportation apparatus includes a transportation portion for transporting a medium; a first structure unit for forming a first transportation path to guide and transport the medium in a first direction from an upstream side in a medium transportation direction toward a downstream side in the medium transportation direction; and a second structure unit for forming an accommodation space to accommodate a part of the first structure unit.

According to the third aspect of the present invention, the method of assembling the medium transportation apparatus includes the steps of attaching the second structure unit to a main body structure portion of the image forming apparatus so that the accommodation space is formed; placing the first structure unit so that the first structure unit includes a first region disposed outside the accommodation space on the downstream side in the medium transportation direction and a second region disposed inside the accommodation space on the upstream side in the medium transportation direction; adjusting a length of the second region in the first direction to set a transportation path length of the first region; and attaching the first structure unit to the main body structure portion of the image forming apparatus.

According to the present invention, the first structure unit for guiding the medium includes the first region for forming the first transportation path, and the second region accommodated in the accommodation space of the second structure unit. Accordingly, it is possible to set the transportation path length, that is, the length of the first region forming the first transportation path, through adjusting the length of the second region. As a result, it is possible to communize the first structure unit, that is, a main component constituting a medium reversing transportation path, regardless of a size of an image forming apparatus.

DETAILED DESCRIPTION OF PREFERRED EMBODIMENTS

Hereunder, embodiments of the present invention will be explained with reference to the accompanying drawings.

First Embodiment

Figure 1:
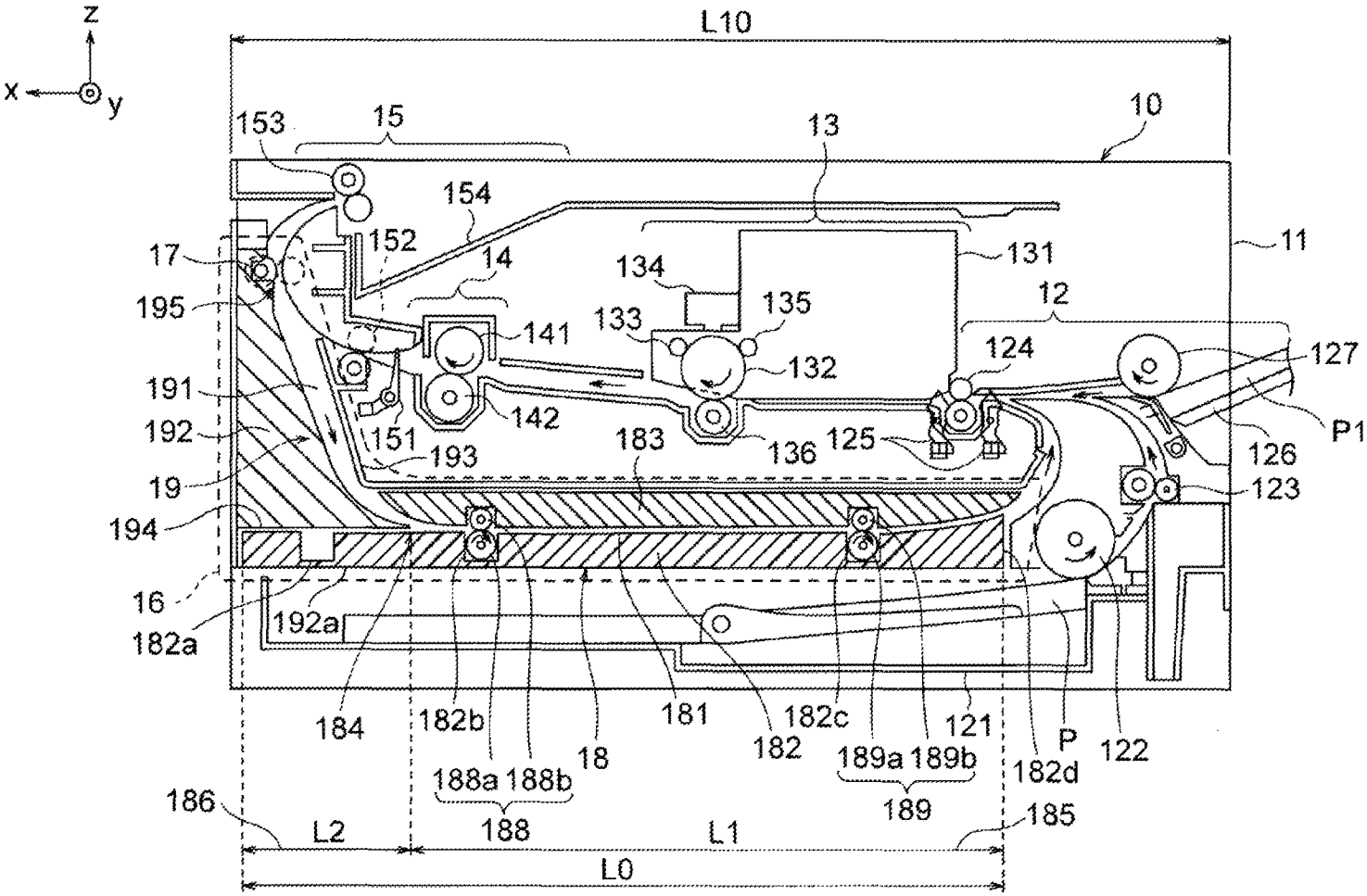
FIG. 1 is a schematic sectional view showing a configuration of a monochrome image forming apparatus as an image forming apparatus including a medium transportation apparatus according to a first embodiment of the present invention.

A first embodiment of the present invention will be explained. FIG. 1 is a schematic sectional view showing a configuration of a monochrome image forming apparatus as an image forming apparatus 10 including a medium transportation apparatus 16 (a medium reverse transportation portion) according to the first embodiment of the present invention.

Figure 2:
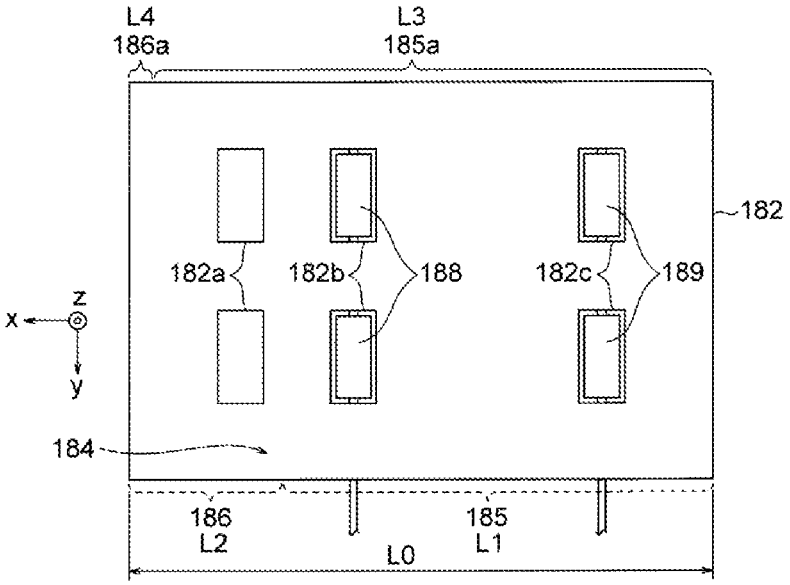
FIGS. 2(*a*) and 2(*b*) are schematic views showing a first plate member as a first structure unit of a first guide portion of the medium transportation apparatus according to the first embodiment of the present invention, wherein FIG. 2(*a*) is a schematic plan view showing the first structure unit, and FIG. 2(*b*) is a schematic perspective view showing the first structure unit.
Figure 2:
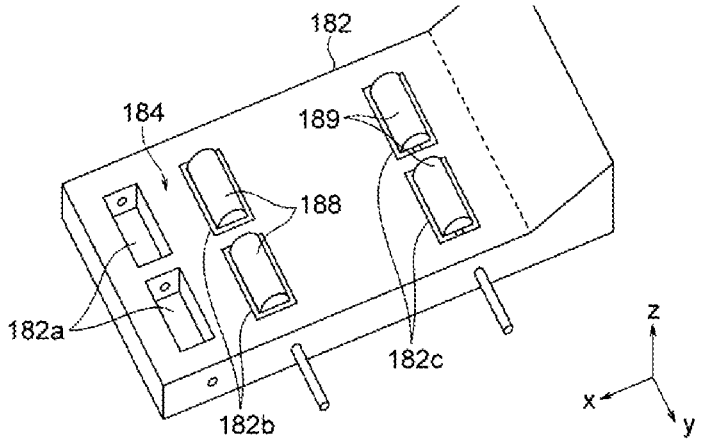

FIGS. 2(*a*) and 2(*b*) are schematic views showing a first structure unit (a first plate member) 182 of a first guide portion 18 of the medium transportation apparatus 16 according to the first embodiment of the present invention. More specifically, FIG. 2(*a*) is a schematic plan view showing the first structure unit (the first plate member) 182, and FIG. 2(*b*) is a schematic perspective view showing the first structure unit (the first plate member) 182.

In the first embodiment, the image forming apparatus 10 shown in FIG. 1 is an apparatus capable of forming an image on both side surfaces of a medium P. When the image forming apparatus 10 performs the duplex printing operation, first, an image forming portion 13 of the image forming apparatus 10 forms a first image on one side surface of the medium P. Afterward, the medium transportation apparatus 16 reverses the front side and the backside of the medium P, and returns the medium P to a position in front of the image forming portion 13. In the next step, the image forming portion 13 forms a second image on the other side surface of the medium P transported thereto.

In the first embodiment, the first structure unit (the first plate member) 182 constitutes a primary component of the medium transportation apparatus 16. Further, the first structure unit (the first plate member) 182 is configured such that the first structure unit (the first plate member) 182 can be used in various types of apparatus having different sizes, that is, the primary component constituting the medium reverse transportation unit can be communized.

In the first embodiment, the image forming apparatus 10 is configured to form the images on the medium P such as a sheet through an electro-photography method according to image data transmitted from an external device such as a computer and the like. It should be noted that the present invention is not limited to the image forming apparatus using the electro-photography method, and may be applicable to an image forming apparatus using other printing method. Further, as far as the medium transportation apparatus 16 includes the medium reverse transportation portion for reversing the front side and the backside of the medium P and transporting the medium P, the medium transportation apparatus 16 is applicable to an apparatus other than the image forming apparatus (for example, an image reading apparatus and the like).

As shown in FIG. 1, the image forming apparatus 10 includes, as primary components, a main body structure portion 11 (a frame) for supporting each component inside the image forming apparatus 10 or with each component inside the image forming apparatus 10 fixed thereto; the image forming portion 13 for forming a developer image (a toner image) on the medium P using the electro-photography method; a medium supplying portion (a sheet supplying portion) 12 for supplying the medium P to the image forming portion 13; a fixing device 14 for fixing the toner image formed on the medium P to the medium P; a sheet discharging portion 15 for discharging the medium P passed through the fixing device 14 to outside the image forming apparatus 10; and the medium transportation apparatus 16 for reversing the front side and the backside of the medium P and returning the medium P to the position in front of the image forming portion 13 (a position of a transportation roller pair 124).

As shown in FIG. 1, the medium supplying portion (the sheet supplying portion) 12 includes a sheet supplying roller 122 for feeding the medium P one by one as a sheet member such as a sheet placed in a medium cassette 121 (a sheet cassette); the transportation roller pair 123 for transporting the medium P transported from the medium cassette 121 toward the image forming portion 13; a transportation roller pair 124 for transporting the medium P; and a medium sensor 125 for detecting the medium P. Further, the medium supplying portion (the sheet supplying portion) 12 includes a medium tray (a sheet tray) 126 separated from the medium cassette 121; and a sheet supplying roller 127 for feeding the medium P one by one as the sheet member such as the sheet placed on the sheet tray 126.

As shown in FIG. 1, the image forming portion 13 includes an image forming cartridge 131 (an image drum cartridge) detachably attached to the main body structure portion 11; and an exposure optical unit 134 disposed above the image forming cartridge 131. It should be noted that the image forming portion 13 is normally arranged at an upper portion inside the image forming apparatus 10.

In the first embodiment, the image forming cartridge 131 includes a photosensitive drum 132 as an image supporting member; a charging device 133 for uniformly charging a surface of the photosensitive drum 132; and a developing portion 135 for supplying toner as developer to the surface of the photosensitive drum 132 to form the developer image corresponding to a static latent image after the exposure optical unit 134 exposes the surface of the photosensitive drum 132. It should be noted that the exposure optical unit 134 exposes the surface of the photosensitive drum 132 thus uniformly charged according to the image data thus input.

In the first embodiment, the image forming portion 13 further includes a transfer roller 136 for transferring the developer image formed on the photosensitive drum 132 to the medium P. It should be noted that the image forming portion 13 may include a plurality of image forming cartridges (described later in a second embodiment). The exposure optical unit 134 is formed of an LED (Light Emitting Diode) head, in which a plurality of LED elements is arranged in an axial direction of the photosensitive drum 132 (the y direction in FIG. 1). It should be noted that the exposure optical unit 134 may be formed of a laser scanning unit having a laser irradiating portion and a polygon mirror (a rotational multiple mirror for scanning).

As shown in FIG. 1, the fixing device 14 includes a pair of rollers 141 and 142 arranged to abut against each other. The roller 141 is a heat roller having a heating heater disposed therein, and the roller 142 is a pressing roller arranged to be pressed against the roller 141. After the transfer roller 136 transfers the developer image (the toner image), which is not fixed yet, to the medium P, the medium P passes through between the pair of the rollers 141 and 142. At this moment, the toner image not fixed yet is heated and pressed, so that the toner image is fixed to the medium P.

As shown in FIG. 1, the sheet discharging portion 15 includes a medium sensor 151 for detecting the medium P passing through; a transportation roller pair 152; a roller pair 153; and a sheet discharging tray 154. The transportation roller pair 152 is arranged to abut against and face with each other. The roller pair 153 is arranged to abut against and face with each other. The transportation roller pair 152 has a surface formed of for example, a rigid member such as a plastic and the like, or an elastic member such as a rubber and the like. The roller pair 153 has a surface formed of for example, a rigid member such as a plastic and the like, or an elastic member such as a rubber and the like.

In the first embodiment, further, the transportation roller pair 152 is connected to a drive portion including a transportation motor and a drive force transmission mechanism formed of a gear for transmitting a rotational drive force. When the transportation roller pair 152 is driven to rotate, the transportation roller pair 152 transports the medium P. Further, the roller pair 153 is connected to the drive portion including the transportation motor and the drive force transmission mechanism formed of a gear for transmitting a rotational drive force. When the roller pair 153 is driven to rotate, the roller pair 153 transports the medium P.

As shown in FIG. 1, the medium transportation apparatus 16 includes as primary components a roller pair 17 as a transportation portion for transporting the medium P; the first guide portion 18 for forming a first transportation path 181; and a second guide portion 19 for forming a second transportation path 191. The first transportation path 181 is provided for guiding and transporting the medium P in a first direction (the −x direction in FIG. 1) from an upstream side in a medium transportation direction toward a downstream side in the medium transportation direction. The second transportation path 191 is provided for guiding and transporting the medium P in a direction inclined relative to the first direction (the −x direction in FIG. 1) and in the direction from the roller pair (the transportation portion) 17 toward the first transportation path 181.

As shown in FIG. 1, the first guide portion 18 includes the first plate shape member (the first structure unit) 182 fixed to the main body structure portion 11 and a second plate shape member 183 fixed to the main body structure portion 11 to face the first structure unit (the first plate member) 182. The first transportation path 181 is formed between the first structure unit (the first plate member) 182 and the second plate shape member 183.

As shown in FIG. 1 and FIGS. 2(*a*) and 2(*b*), the first structure unit (the first plate member) 182 includes roller holding portions 182*a*, 182*b*, and 182*c* formed as a recessed shape groove capable of supporting transportation rollers to be freely rotatable. The first plate shape member (the first structure unit) 182 includes the roller holding portions 182*a*, 182*b*, and 182*c* arranged as three rows along the first direction. It should be noted that the first structure unit (the first plate member) 182 may include the roller holding portions not limited to the three rows.

In the first embodiment, the second guide portion 19 includes a first member (a second structure unit) 192 fixed to the main body structure portion 11 and a second member 193 fixed to the main body structure portion 11 to face the first member (the second structure unit) 192. The second transportation path 191 is formed between the first member (the second structure unit) 192 and the second member 193. It should be noted that the first member (the second structure unit) 192 of the second guide portion 19 is constituted as a separate component from the first structure unit (the first plate member) 182 of the first guide portion 18. Further, it is preferred that the first member (the second structure unit) 192 is arranged adjacent to the first structure unit (the first plate member) 182.

In the first embodiment, the first structure unit (the first plate member) 182 is disposed on the downstream side in the medium transportation direction (below in the vertical direction in FIG. 1) relative to the second transportation path 191 of the first member (the second structure unit) 192. Further, the first member (the second structure unit) 192 is configured to create an accommodation space 194 situated on the downstream side in the medium transportation direction (below in the vertical direction in FIG. 1) relative to the second transportation path 191 of the first member (the second structure unit) 192.

In the first embodiment, the first structure unit (the first plate member) 182 is arranged such that a part of an end portion of the first structure unit (the first plate member) 182 on the upstream side in the medium transportation direction is accommodated in the accommodation space 194. It should be noted that, when the first structure unit (the first plate member) 182 is accommodated in the accommodation space 194, the part of the first structure unit (the first plate member) 182 accommodated in the accommodation space 194 is longer than 5% of a length (LO) of the first structure unit (the first plate member) 182 in a longitudinal direction thereof.

As described above, in the image forming apparatus 10 and the medium transportation apparatus 16 in the first embodiment, the first member (the second structure unit) 192 is configured to form the accommodation space 194 capable of accommodating the part of the first structure unit (the first plate member) 182. Accordingly, the first structure unit (the first plate member) 182 includes a transportation path forming portion 185 (refer to FIG. 2(*a*)) as a first region disposed outside the accommodation space 194 on the downstream side in the medium transportation direction for forming the first transportation path 181, and a transportation path length adjusting portion 186 (refer to FIG. 2(*a*)) as a second region disposed inside the accommodation space 194 on the downstream side in the medium transportation direction for adjusting a transportation path length L1, that is a length of the transportation path forming portion 185 in the first direction.

As shown in FIG. 1, the transportation path length adjusting portion 186 has a length L2 in the first direction, and the first structure unit (the first plate member) 182 has the length LO in the first direction (L0=L1+L2). Further, the first structure unit (the first plate member) 182 includes a receiving surface 184 such that a leading edge of the medium P abuts against the receiving surface 184 when the medium P is transported from the second transportation path 191 toward the first transportation path 181.

In the first embodiment, it is preferred that the first member (the second structure unit) 192 constituting the second transportation path 191 has a surface curved downwardly over a range from the roller pair 17 to the receiving surface 184 of the first structure unit (the first plate member) 182. When it is supposed that an upper surface of the first structure unit (the first plate member) 182 constituting the first transportation path 181 is considered as a horizontal plane (an x-y plane in FIG. 1), it is preferred that the accommodation space 194 is formed below the second transportation path 191 in the vertical direction (the -z direction in FIG. 1).

In the first embodiment, it is preferred that the first member (the second structure unit) 192 constituting the second transportation path 191 has a sectional surface having a substantially C-character shape along an imaginary plane (the x-z plane) in parallel to both the surface of the first member (the second structure unit) 192 in the first direction (the -x direction) and the surface of the first member (the second structure unit) 192 in the vertical direction (the -z direction). Further, it is preferred that the accommodation space 194 is formed near a top portion of the surface of the first member (the second structure unit) 192 constituting the second transportation path 191 and having the substantially C-character sectional shape, that is, near a point 195 below in the vertical direction (the -z direction).

As shown in FIG. 1, the first guide portion 18 includes a transportation roller pair 188 and a transportation roller pair 189. The transportation roller pair 188 is formed of a pair of a roller 188*a* and a roller (a pressure roller) 188*b*. The transportation roller pair 189 is formed of a pair of a roller 189*a* and a roller (a pressure roller) 189*b*. The roller 188*a* and the roller 189*a* have one end portions of axes thereof supported on a bearing portion disposed inside the roller holding portions 182*b* and 182*c* of the first structure unit (the first plate member) 182 to be freely rotatable. The other end portions of the axes of the roller 188*a* and the roller 189*a* extend outside the first structure unit (the first plate member) 182, and are supported on a bearing portion disposed in the second plate shape member 183 to be freely rotatable. Further, the roller 188*b* and the roller 189*b* have one end portions of axes thereof supported on a bearing portion disposed inside the roller holding portions of the first structure unit (the first plate member) 182 to be freely rotatable.

In the first embodiment, the sheet discharging portion 15 includes a motor. An axis of the motor is connected to the axes of the roller 188*b* and the roller 189*b* through a driving force transmission mechanism such as an endless transmission belt and the like, so that the roller 188*b* and the roller 189*b* receive a driving force of the motor to rotate. It should be noted that the motor is disposed at a location other than the sheet discharging portion 15, and may be disposed, for example, near the first guide portion 18, or on an inner surface of the housing of the image forming apparatus 10.

In the first embodiment, an axis of the transportation motor may be connected to the axes of the roller 188*b* and the roller 189*b* through a driving force transmission mechanism such as an endless transmission belt and the like, so that the roller 188*b* and the roller 189*b* receive a driving force of the motor to rotate. Further, gears may be disposed on the end portions of the axes of the roller 188*a*, the roller 189*a*, the roller 188*b*, and the roller 189*b*. Then, it is configured such that the gears are directly connected to a gear disposed on the rotational axis of the motor, so that the roller 188*a*, the roller 189*a*, the roller 188*b*, and the roller 189*b* are driven to rotate.

As shown in FIG. 1, the first guide portion 18 is disposed below the image forming portion 13. Further, the first guide portion 18 includes the first transportation path 181 as a reverse transportation path arranged in parallel to the transportation path of the medium P between the transportation roller 124 and the transportation roller pair 152. Further, the transportation roller pair 188 and the transportation roller pair 189 are disposed in the first transportation path 181 as the reverse transportation path.

In the first embodiment, the medium sensor 151 includes a sensor lever 151*a* for detecting the medium P. The sensor lever 151*a* is arranged on the upstream side in the medium transportation direction, and having an axis supported on the second member 193. Further, the medium sensor 151 includes a photo coupler 151*b* attached to the second member 193 for detecting a rotation of the sensor lever 151*a*. When the medium P does not exist, a part of the sensor lever 151*a* blocks a sensor portion of the photo coupler 151*b*.

In the first embodiment, the sensor lever 151*a* is provided with a torsion spring (not shown). One end portion of the torsion spring is arranged to contact with a rib of the second member 193. The torsion spring is provided for urging the sensor lever 151*a* in the clockwise direction (refer to FIG. 4), so that the senor lever 151*a* abuts against a stopper of the second member 193. When the leading edge of the medium P abuts against the sensor lever 151*a*, the sensor lever 151*a* is rotated in the counterclockwise direction (refer to FIG. 4).

In the first embodiment, the second guide portion 19 for guiding the medium P; the roller pair (the transportation portion) 17 as the medium transportation portion; and the roller pair 153 as the medium transportation portion are disposed on the downstream side of the transportation roller pair 152 in the medium transportation direction. At least one axis of one roller constituting the roller pair (the transportation portion) 17 is connected to the drive portion formed of the motor and the driving force transmission mechanism. When the motor is driven in the forward direction or the opposite direction, the roller pair (the transportation portion)

17 is capable of rotating the medium P in the forward direction (the direction toward the sheet discharging tray 154) or the opposite direction (the direction toward the first guide portion 18 of the medium transportation apparatus 16).

In the first embodiment, at least one axis of one roller constituting the roller pair 153 is connected to the drive portion formed of the motor and the driving force transmission mechanism. When the motor is driven in the forward direction or the opposite direction, the roller pair 153 is capable of rotating the medium P in the forward direction (the direction toward the sheet discharging tray 154) or the opposite direction (the direction toward the first guide portion 18 of the medium transportation apparatus 16). When an image is formed on both surfaces of the medium P, the roller pair (the transportation portion) 17 and the roller pair 153 function as a reverse member for transporting the medium P into the first transportation path 181 as the medium reverse transportation path for forming an image on the backside surface of the medium P after an image is formed on one surface (the front side surface) of the medium P.

In the first embodiment, after an image is formed on one surface of the medium P, the roller pair (the transportation portion) 17 and the roller pair 153 are rotated in the forward direction, so that the medium P is transported in the forward direction. When the roller pair (the transportation portion) 17 and the roller pair 153 are rotated in the opposite direction just before the medium P is discharged into the sheet discharging tray 154, the medium P is transported in the opposite direction. Then, the first member (the second structure unit) 192 guides the medium P to be transported into the first transportation path 181.

Figure 3:
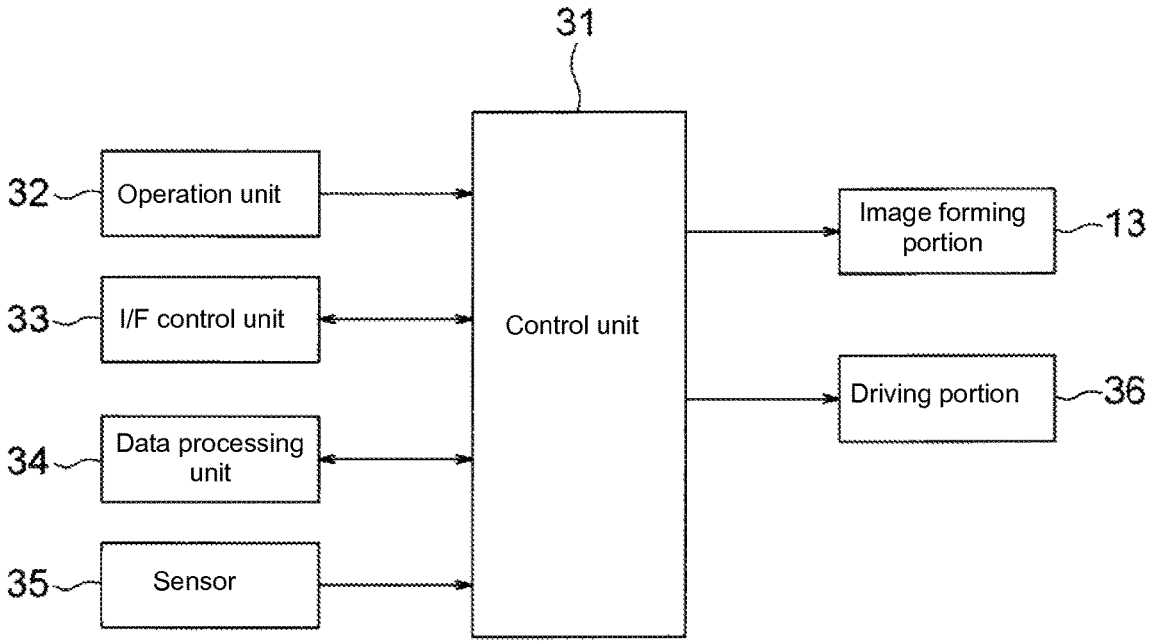
FIG. 3 is a block diagram showing a control system of the image forming apparatus including the medium transportation apparatus according to the first embodiment of the present invention.

FIG. 3 is a block diagram showing a control system of the image forming apparatus 10 including the medium transportation apparatus 16 according to the first embodiment of the present invention.

As shown in FIG. 3, the image forming apparatus 10 includes as primary components a control unit 31; an operation unit 32; an interface control unit (an I/F control unit) 33; a data processing unit 34; a sensor 35; a driving portion 36; and the image forming portion 13. The control unit 31 is formed of a CPU (Central Processing Unit) and the like, and is configured to control an operation of the image forming apparatus 10 as a whole. Further, the control unit 31 is configured to control the sensor 35 to detect a location of the medium P, so that the control unit 31 controls an operation of the image forming portion 13 and the driving portion 36 according to a detecting signal output from the sensor 35.

In the first embodiment, the sensor 35 includes the medium sensor 125, the medium sensor 151, and the like shown in FIG. 1. The operation unit 32 includes an operation button for inputting a print instruction to the image forming apparatus 10; an operation panel; a liquid crystal display panel for displaying a status of the image forming apparatus 10; and the like. The I/F control unit 33 is configured to receive the print instruction or print data transmitted from an external device such as a computer, and to transmit the print instruction or the print data to the control unit 31. The data processing unit 34 is configured to receive the print data and the like according to the control of the control unit 31. Further, the data processing unit 34 is configured to convert the print data to an image signal, and to supply the image signal to the image forming portion 13. The driving portion 36 includes the motor, a motor driving circuit, and the like for driving the transportation rollers 123, 124, 152, 188, and 189 for transporting the medium P; the pressure roller 188*a*; the photosensitive drum 132 of the image forming portion 13; the heating roller 141 of the fixing device 14; and the like.

An operation of the image forming apparatus 10 and the medium transportation apparatus 16 will be explained next with reference to FIG. 1. When the print instruction is input into the control unit 31 of the image forming apparatus 10, the sheet supplying roller 122 of the medium supplying portion (the sheet supplying portion) 12 picks up the medium P from the medium cassette 121 one by one. In the next step, the transportation roller 123 and the transportation roller 124 transport the medium P to the pressing portion (the transfer position) between the photosensitive drum 132 and the transfer roller 136 of the image forming portion 13. When the medium P passes through the transfer position, the developer image (the toner image) formed on the photosensitive drum 132 is transferred to the medium P. After the toner image is transferred to the medium P, the medium P is transported to the fixing device 14. In the fixing device 14, the toner image is heated and pressed, so that the toner image is fixed to the medium P.

In the next step, when only one side surface of the medium P is printed, after the image is fixed to the medium P in the fixing device 14, the transportation roller pair 152 and the roller pair 17 transport the medium P in the discharging direction. Afterward, the transportation roller pair 152 is rotated in the forward direction, so that the medium P is discharged on the sheet discharging tray 154.

Figure 4:
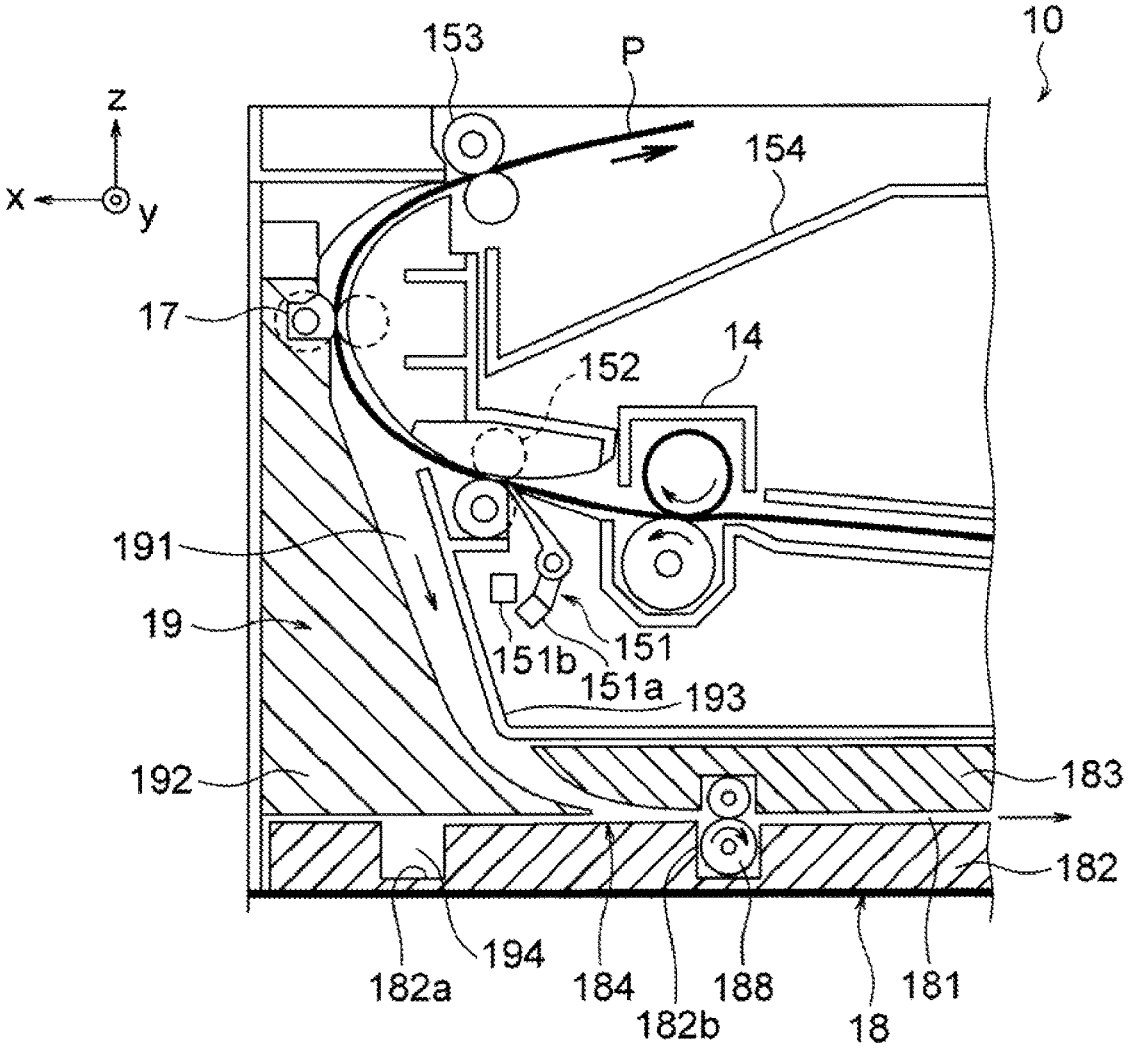
FIG. 4 is a schematic sectional view showing the image forming apparatus in a medium reverse transportation operation (during a forward transportation) according to the first embodiment of the present invention.
Figure 5:
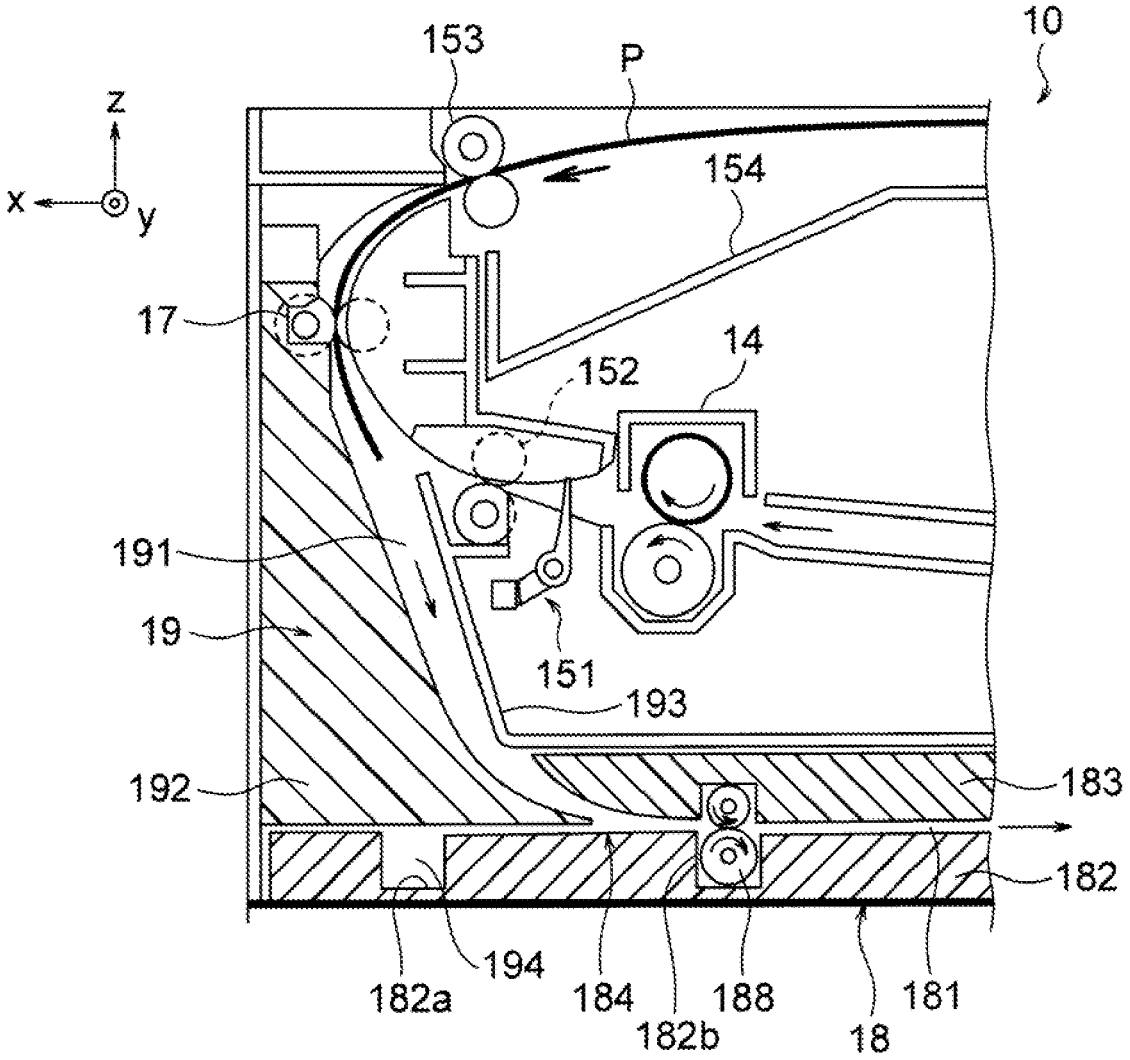
FIG. 5 is a schematic sectional view showing the image forming apparatus in the medium reverse transportation operation (at a start of a switchback) according to the first embodiment of the present invention.
Figure 6:
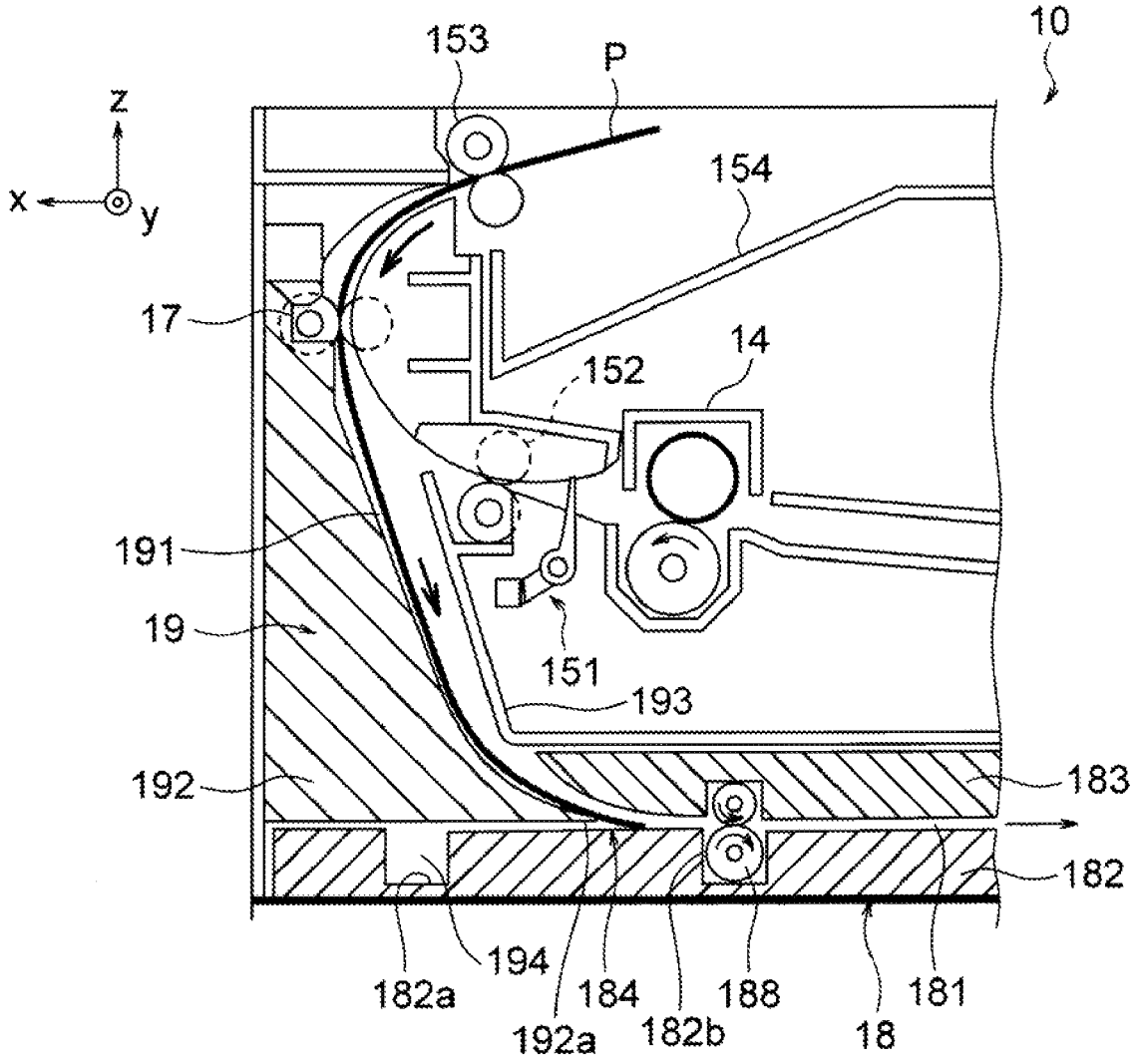
FIG. 6 is a schematic sectional view showing the image forming apparatus in the medium reverse transportation operation (during a backward transportation) according to the first embodiment of the present invention.

An operation of the image forming apparatus 10 and the medium transportation apparatus 16 will be explained next when both side surfaces of the medium P are printed. FIG. 4 is a schematic sectional view showing the image forming apparatus 10 in the medium reverse transportation operation (during the forward transportation) according to the first embodiment of the present invention. FIG. 5 is a schematic sectional view showing the image forming apparatus 10 in the medium reverse transportation operation (at a start of a switchback) according to the first embodiment of the present invention. FIG. 6 is a schematic sectional view showing the image forming apparatus 10 in the medium reverse transportation operation (during the backward transportation) according to the first embodiment of the present invention.

In the first embodiment, when both side surfaces of the medium P are printed, first, the image is formed on one side surface of the medium P. In the next step, as shown in FIG. 4, after the medium P passes through the fixing device 14, the leading edge of the medium P contacts with the sensor lever 151*a*, so that the sensor lever 151*a* is rotated in the counterclockwise direction in FIG. 4. As a result, the light blocking portion of the sensor lever 151 is shifted from the front position of the sensor portion of the photo coupler 151*b*. Accordingly, the medium sensor 151 detects the medium P (that the medium P is passing through).

In the next step, as shown in FIG. 5, the transportation roller pair 152 transports and guides the medium P into the second transportation path 191 of the second guide portion 19. Afterward, the transportation roller pair 152, the roller pair 17, and the roller pair 153 transport the medium P, so that the trailing edge of the medium P passes through the sensor lever 151*a*. As a result, the sensor lever 151*a* is rotated in the clockwise direction in FIG. 4 with the urging force of the torsion spring. As a result, the light blocking portion of the sensor lever 151 blocks the sensor portion of the photo coupler 151*b*. Accordingly, the medium sensor 151 detects that the medium P completely passes through.

An operation of transporting the medium P to the first transportation path 181 will be explained next. After the roller pair 17 and the roller pair 153 transport the medium P for a specific distance, as shown in FIG. 5, the roller pair 17 and the roller pair 153 are rotated in the opposite direction. Accordingly, the medium P is guided to the first member (the second structure unit) 192 and the second member 193. As described above, the first structure unit (the first plate member) 182 includes the receiving surface 184 capable of contacting with the leading edge of the medium P transported from the second transportation path 191. When the leading edge of the medium P transported from the second transportation path 191 contacts with the receiving surface 184 in the first direction (the horizontal direction in FIGS. 1 and 6), the medium P can be transported into the first transportation path 181. Afterward, the medium P is guided toward the first structure unit (the first plate member) 182 and the second plate shape member 183 arranged on the downstream side in the medium transportation direction, and is further transported toward the transportation roller pair 188.

In the next step, when the transportation roller pair 188 and the transportation roller pair 189 shown in FIG. 1 are rotated, the medium P is transported once again in front of the image forming portion 13, so that the photosensitive drum 132 and the transfer roller 136 transfer the toner image formed on the photosensitive drum 132 to the backside surface (the other side surface) of the medium P. Afterward, the medium P passes through the fixing device 14, so that the toner image is fixed to the medium P. When the transportation roller pair 152, the roller pair 17, and the roller pair 153 are rotated in the forward direction, the medium P is discharged on the sheet discharging tray 154.

An effect of the first embodiment will be explained next. As shown in FIG. 1, the second transportation path 191 is curved (is formed in a substantially C-character shape) from the location where the roller pair 153 is disposed toward the first structure unit (the first plate member) 182 of the first guide portion 18. Accordingly, it is possible to form the accommodation space 194 below the second transportation path 191 in the vertical direction (the −z direction) in the case that the upper surface (the xy plane) of the first structure unit (the first plate member) 182 constituting the first transportation path 181 is considered as the horizontal direction. In other words, the second transportation path 191 is curved from the location where the roller pair 153 is disposed toward the first structure unit (the first plate member) 182 of the first guide portion 18, so that the second transportation path 191 has a sectional shape having a substantially C-character shape taken along the imaginary plane in parallel to the x-z plane. Accordingly, it is possible to form the accommodation space 194 below the curved portion of the second transportation path 191 with the substantially C-character shape in the vertical direction (the −z direction). As a result, the accommodation space 194 is situated at a dead space below the medium transportation path (the second transportation path 191) that is not effectively utilized in the past. Accordingly, as opposed to a case that the accommodation space 194 is formed somewhere else, it is possible to minimize the size of the medium transportation apparatus 16 and the image forming apparatus 10.

Further, in the first embodiment, as shown in FIG. 1, the first structure unit (the first plate member) 182 includes the roller holding portions 182*a*, 182*b*, and 182*c* capable of holding the transportation roller pairs 188 and 189 to be freely rotatable for transporting the medium P. In the medium transportation apparatus 16, it is possible to accommodate some of the roller holding portions 182*a*, 182*b*, and 182*c*, where the transportation roller pairs 188 and 189 are not accommodated, in the accommodation space 194 while the other of the roller holding portions 182*a*, 182*b*, and 182*c* hold the transportation roller pairs 188 and 189.

For example, in the first embodiment, the roller holding portions 182*b* and 182*c* hold the transportation roller pairs 188 and 189, and the holding portion 182*a* does not hold the transportation roller pairs 188 and 189. Further, the end portion of the first structure unit (the first plate member) 182 on the upstream side in the medium transportation direction is accommodated in the accommodation space 194. In other words, the first structure unit (the first plate member) 182 includes a plurality of roller holding portions, i.e., the roller holding portions 182*a*, 182*b*, and 182*c*, and it is possible to accommodate the region of the first structure unit (the first plate member) 182, where the transportation roller pairs 188 and 189 are not held, in the accommodation space 194.

Further, in the image forming apparatus 10 for forming a monochrome image shown in FIG. 1, even when the roller holding portion 182*a* does not hold the transportation roller pairs 188 and 189, the roller holding portions 182*b* and 182*c* can hold the transportation roller pairs 188 and 189. In other words, the transportation path length L1 of the first structure unit (the first plate member) 182 is set to the length of the first structure unit (the first plate member) 182 as the reverse transportation path of another image forming apparatus such as a color image forming apparatus, so that the first structure unit (the first plate member) 182 can be used in the image forming apparatus 10 in the first embodiment. Accordingly, it is possible to use the first structure unit (the first plate member) 182 for both the monochrome image forming apparatus and the color image forming apparatus.

More specifically, in the first embodiment, the first structure unit (the first plate member) 182 for guiding the medium P includes the transportation path forming portion 185 constituting the first transportation path 181 and the transportation path length adjusting portion 186 accommodated in the accommodation space 194 of the first member (the second structure unit) 192. Accordingly, it is possible to adjust the transportation path length L1, that is, the length of the transportation path forming portion 185 constituting the first transportation path 181, through adjusting the length L2 of the transportation path length adjusting portion 186. As a result, it is possible to communize the first structure unit (the first plate member) 182, that is the primary component constituting the medium reverse transportation path, in various types of apparatus having different sizes.

Second Embodiment

A second embodiment of the present invention will be explained next.

Figure 7:
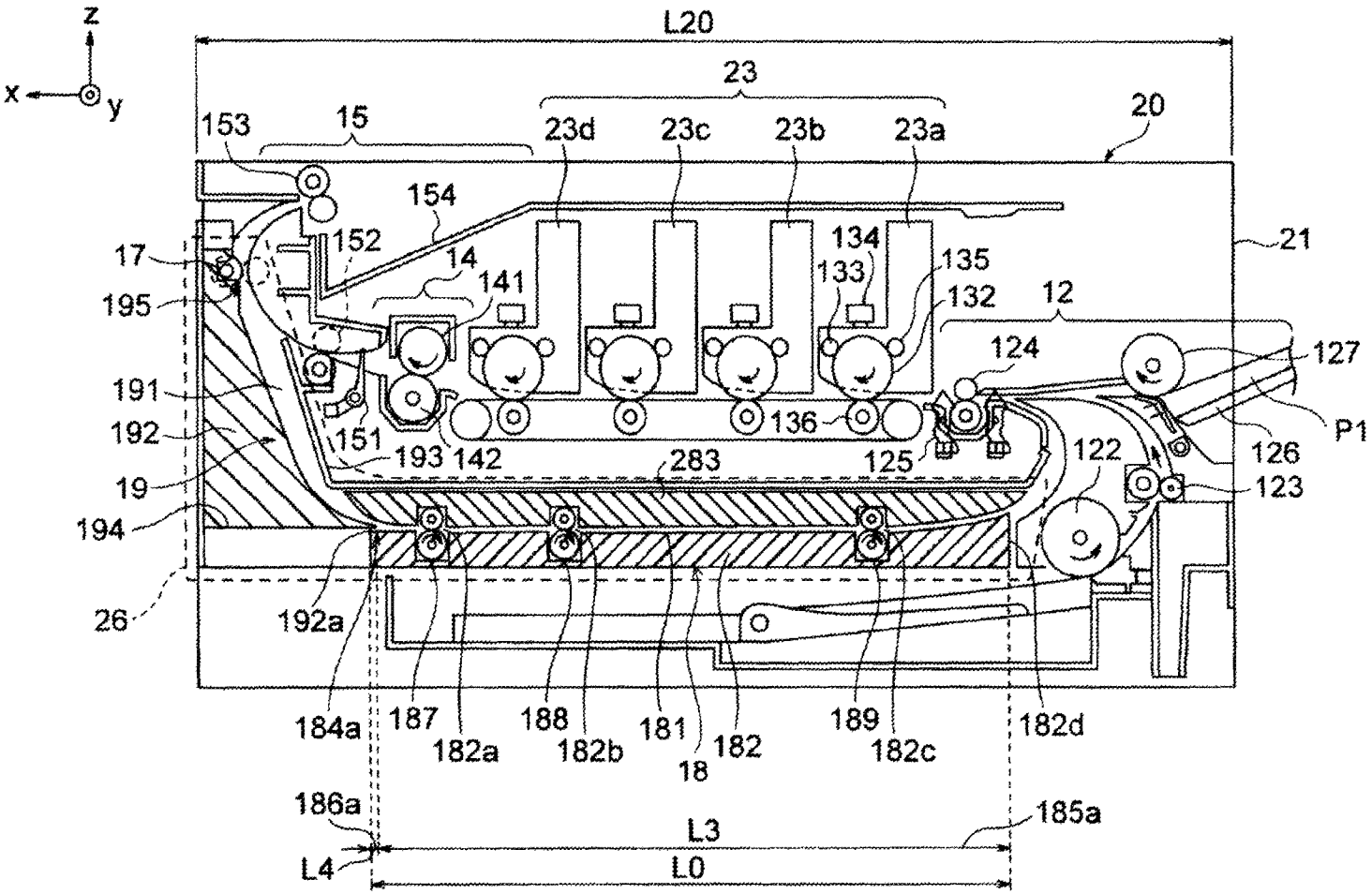
FIG. 7 is a schematic sectional view showing a configuration of a color image forming apparatus as an image forming apparatus including a medium transportation apparatus according to a second embodiment of the present invention.

FIG. 7 is a schematic sectional view showing a configuration of a color image forming apparatus as an image forming apparatus 20 including a medium transportation apparatus 26 (a medium reverse transportation portion) according to the second embodiment of the present invention. It should be noted that components in the second embodiment shown in FIG. 7 similar or corresponding to those in the first embodiment shown in FIG. 1 are designated with the same reference numerals shown in FIG. 1.

Figure 8:
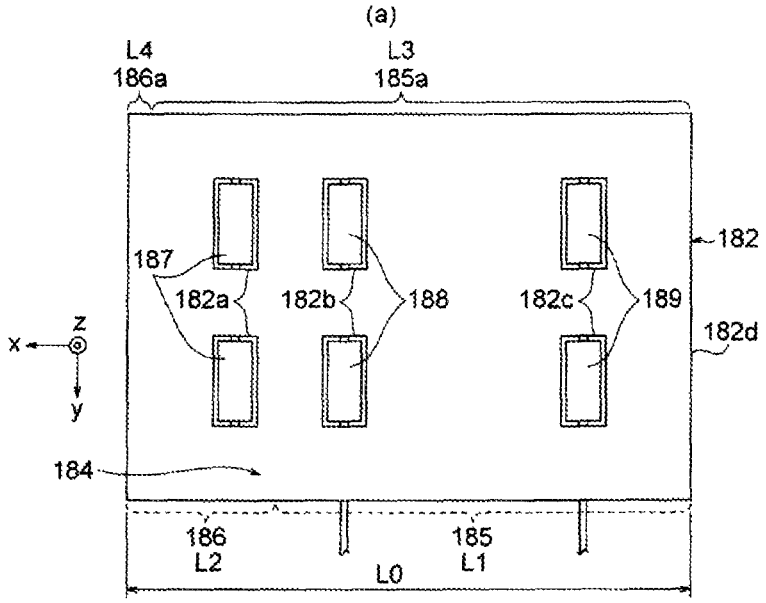
FIGS. 8(*a*) and 8(*b*) are schematic views showing a first plate member as a first structure unit of a first guide portion of the medium transportation apparatus according to the second embodiment of the present invention, wherein FIG. 8(*a*) is a schematic plan view showing the first plate member, and FIG. 8(*b*) is a schematic perspective view showing the first plate member.
Figure 8:
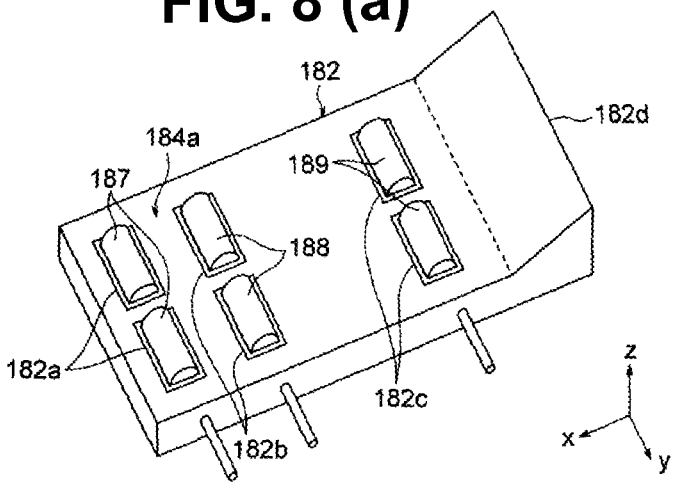

FIGS. 8(*a*) and 8(*b*) are schematic views showing the first structure unit (the first plate member) 182 of the first guide portion 18 of the medium transportation apparatus 26 according to the second embodiment of the present invention. More specifically, FIG. 8(*a*) is a schematic plan view showing the first structure unit (the first plate member) 182, and FIG. 8(*b*) is a schematic perspective view showing the first structure unit (the first plate member) 182. It should be noted that components in the second embodiment shown in FIGS. 8(*a*) and 8(*b*) similar or corresponding to those in the first embodiment shown in FIGS. 2(*a*) and 2(*b*) are designated with the same reference numerals shown in FIGS. 2(*a*) and 2(*b*).

Figure 9:
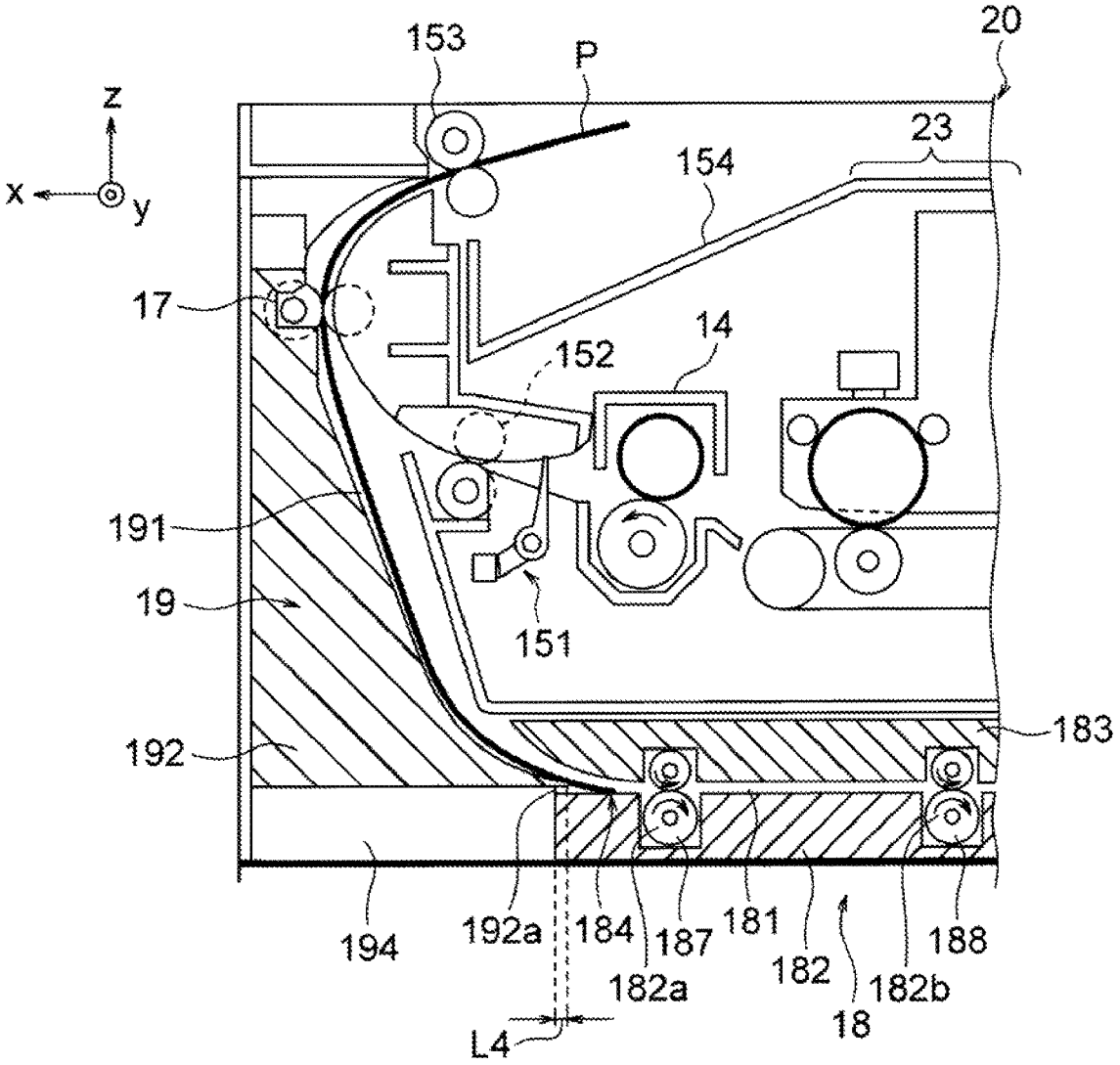
FIG. 9 is a schematic sectional view showing the image forming apparatus in a medium reverse transportation operation (during a backward transportation) according to the second embodiment of the present invention.

FIG. 9 is a schematic sectional view showing the image forming apparatus 20 in the medium reverse transportation operation (during a backward transportation) according to the second embodiment of the present invention. It should be noted that components in the second embodiment shown in FIG. 9 similar or corresponding to those in the first embodiment shown in FIG. 6 are designated with the same reference numerals shown in FIG. 6.

As shown in FIG. 7, the image forming apparatus 20 has a configuration different from that of the image forming apparatus 10 in the first embodiment. More specifically, the image forming apparatus 20 includes a housing having a length L20 in the x direction larger than the length L10 (refer to FIG. 1) of the housing of the image forming apparatus 10 in the first embodiment. Further, the image forming apparatus 20 includes an image forming portion 23 formed of a plurality (for example, four) of image forming cartridges (image forming units or image drum cartridges) 23*a*, 23*b*, 23*c*, and 23*d* for forming a color image. Further, the medium transportation apparatus 26 includes the accommodation space 194, so that only a small portion (a length L4 in FIGS. 7 and 9) of the first structure unit (the first plate member) 182 is accommodated in the accommodation space 194. In the second embodiment, the first structure unit (the first plate member) 182 may not be accommodated in the accommodation space 194. It should be noted that the image forming cartridges 23*a*, 23*b*, 23*c*, and 23*d* are configured to form images in colors such as black, yellow, magenta, and cyan.

As shown in FIG. 7, the medium transportation apparatus 26 includes as primary components the roller pair 17 as the transportation portion for transporting the medium P; the first guide portion 18 for forming the first transportation path 181; and the second guide portion 19 for forming the second transportation path 191. The first transportation path 181 is provided for guiding and transporting the medium P in the first direction (the −x direction in FIG. 7) from the upstream side in the medium transportation direction toward the downstream side in the medium transportation direction. The second transportation path 191 is provided for guiding and transporting the medium P in the direction inclined relative to the first direction (the −x direction in FIG. 7) and in the direction from the roller pair (the transportation portion) 17 toward the first transportation path 181.

As shown in FIG. 7, the first guide portion 18 includes the first plate shape member (a first structure unit) 182 fixed to a main body structure portion 21 and a second plate shape member 283 fixed to the main body structure portion 21 to face the first structure unit (the first plate member) 182. The first transportation path 181 is formed between the first structure unit (the first plate member) 182 and the second plate shape member 283.

As shown in FIG. 7 and FIGS. 8(*a*) and 8(*b*), the first structure unit (the first plate member) 182 includes the roller holding portions 182*a*, 182*b*, and 182*c* formed as the recessed shape groove capable of supporting transportation rollers to be freely rotatable. The first plate shape member (the first structure unit) 182 includes the roller holding portions 182*a*, 182*b*, and 182*c* arranged as three rows along the first direction. It should be noted that the roller holding portions are not limited to the three rows, and the first structure unit (the first plate member) 182 may include the roller holding portions in less than two rows or more than four rows.

In the second embodiment, the second guide portion 19 includes the first member (the second structure unit) 192 fixed to the main body structure portion 21 and the second member 193 fixed to the main body structure portion 21 to face the first member (the second structure unit) 192. The second transportation path 191 is formed between the first member (the second structure unit) 192 and the second member 193. It should be noted that the first member (the second structure unit) 192 of the second guide portion 19 is constituted as the separate component from the first structure unit (the first plate member) 182 of the first guide portion 18. Further, it is preferred that the first member (the second structure unit) 192 is arranged adjacent to the first structure unit (the first plate member) 182.

In the second embodiment, the first structure unit (the first plate member) 182 is disposed on the downstream side in the medium transportation direction (below in the vertical direction, that is, the −z direction in FIG. 7) relative to the second transportation path 191 of the first member (the second structure unit) 192. Further, the first member (the second structure unit) 192 is configured to create the accommodation space 194 situated on the downstream side in the medium transportation direction (below in the vertical direction, that is, the −z direction in FIG. 7) relative to the second transportation path 191 of the first member (the second structure unit) 192.

In the second embodiment, the first structure unit (the first plate member) 182 is arranged such that a part of the end portion of the first structure unit (the first plate member) 182 on the upstream side in the medium transportation direction is accommodated in the accommodation space 194. It should be noted that, when the first structure unit (the first plate member) 182 is accommodated in the accommodation space 194, the part of the first structure unit (the first plate member) 182 accommodated in the accommodation space 194 is longer than 5% of the length (L0) of the first structure unit (the first plate member) 182 in the longitudinal direction thereof.

As described above, in the image forming apparatus 20 and the medium transportation apparatus 26 in the second embodiment, the first member (the second structure unit) 192 is configured to form the accommodation space 194 capable of accommodating the part of the first structure unit (the first plate member) 182. Accordingly, the first structure unit (the first plate member) 182 includes a transportation path forming portion 185*a* (refer to FIG. 8(*a*)) as a first region disposed outside the accommodation space 194 on the downstream side in the medium transportation direction for forming the first transportation path 181, and a transportation path length adjusting portion 186*a* (refer to FIG. 8(*a*)) as a second region disposed inside the accommodation space 194 on the downstream side in the medium transportation direction for adjusting a transportation path length L3, that is a length of the transportation path forming portion 185*a* in the first direction.

As shown in FIG. 7 and FIGS. 8(*a*) and 8(*b*), the transportation path forming portion 185*a* has a length L4 in the first direction, and the first structure unit (the first plate member) 182 has the length L0 in the first direction (L0=L3+L4). Further, the first structure unit (the first plate member) 182 includes a receiving surface 184*a* such that the leading edge of the medium P abuts against the receiving surface 184*a* when the medium P is transported from the second transportation path 191 toward the first transportation path 181.

In the second embodiment, it is preferred that the first member (the second structure unit) 192 constituting the second transportation path 191 has a surface curved downwardly over a range from the roller pair 17 to the receiving surface 184*a* of the first structure unit (the first plate member) 182. When it is supposed that the upper surface of the first structure unit (the first plate member) 182 constituting the first transportation path 181 is considered as the horizontal plane (the x-y plane in FIG. 7), it is preferred that the accommodation space 194 is formed below the second transportation path 191 in the vertical direction (the −z direction in FIG. 7).

In the second embodiment, it is preferred that the first member (the second structure unit) 192 constituting the second transportation path 191 has a sectional surface having a substantially C-character shape along an imaginary plane (the x-z plane) in parallel to both the surface of the first member (the second structure unit) 192 in the first direction (the −x direction) and the surface of the first member (the second structure unit) 192 in the vertical direction (the −z direction). Further, it is preferred that the accommodation space 194 is formed near a top portion of the surface of the first member (the second structure unit) 192 constituting the second transportation path 191 and having the substantially C-character sectional shape, that is, near a point 195 below in the vertical direction (the −z direction).

As shown in FIG. 7, the first transportation path 181 as the medium transportation path for forming an image on the backside surface of the medium P has a length L3 from a position corresponding to a guide distal end portion 192*a* of the first member (the second structure unit) 192 to an end portion 182*d* of the first structure unit (the first plate member) 182. In other words, in the first transportation path 181 shown in FIG. 7, the length on the first transportation path 181 from the position corresponding to the guide distal end portion 192*a* of the first member (the second structure unit) 192 to the end portion 182*d* of the first structure unit (the first plate member) 182 is defined as the length L3. In the image forming apparatus 20 in the second embodiment for printing the color image shown in FIG. 7, the length L3 of the first transportation path 181 is greater in the x direction than the length L1 of the first transportation path 181 of the image forming apparatus 10 in the first embodiment, as the monochrome image forming apparatus shown in FIG. 1.

As shown in FIG. 7, the first guide portion 18 includes a transportation roller pair 187, the transportation roller pair 188, and the transportation roller pair 189. The transportation roller pair 187, the transportation roller pair 188, and the transportation roller pair 189 are respectively held in the roller holding portions 182*a*, 182*b*, and 182*c* of the first structure unit (the first plate member) 182 to be freely rotatable.

Accordingly, in the image forming apparatus 20 in the second embodiment shown in FIG. 7, when the transportation roller pair 187 is removed from the first guide portion 18, it is possible to use the first structure unit (the first plate member) 182 in the image forming apparatus 10 as the monochrome image forming apparatus in the first embodiment shown in FIG. 1, thereby making it possible to communize the component.

As described above, in the first and second embodiments, the first structure unit (the first plate member) 182 is the common component capable of being used both the monochrome image forming apparatus and the color image forming apparatus. When the first structure unit (the first plate member) 182 is used in the color image forming apparatus, the first structure unit (the first plate member) 182 is disposed below the first member (the second structure unit) 192 in the flat plane shape, and the part of the first structure unit (the first plate member) 182 can be accommodated in the accommodation space 194.

In the first and second embodiments, the image forming apparatus 10 shown in FIG. 1 is explained as an example of the monochrome image forming apparatus having the small size, and the image forming apparatus 20 shown in FIG. 7 is explained as an example of the color image forming apparatus having the large size, and the present invention is not limited thereto. For example, when the monochrome image forming apparatus have different sizes, or the color image forming apparatus have different sizes, it is possible to communize the first structure unit (the first plate member) 182 of the first guide portion 18. In other words, regardless of the types of the image forming apparatus, that is, the monochrome image forming apparatus or the color image forming apparatus, it is possible to communize the first structure unit (the first plate member) 182 for various image forming apparatus having different sizes, different types or different shapes.

Further, in the first and second embodiments, the image forming apparatus 10 or the image forming apparatus 20 includes one process unit, so that the toner image is directly transferred to the medium P. The present invention is not limited thereto, and may be applicable to an image processing apparatus for performing an image processing on a transported medium such as a color image forming apparatus using an intermediate transfer belt, a plural color image forming apparatus using a plurality of processing units, a copier using the image forming apparatus, or an automatic original reading apparatus.

Further, in the first and second embodiments, the image forming apparatus 10 is also referred to as a first apparatus, and the image forming apparatus 20 is also referred to as a second apparatus. Further, as described above, the transportation path forming portion 185 of the first structure unit (the first plate member) 182 is referred to as the first region, and the transportation path length adjusting portion 186 of the first structure unit (the first plate member) 182 is referred to as the second region.

Third Embodiment

A third embodiment of the present invention will be explained next. In the third embodiment, a method of assembling the medium transportation apparatus 16 and the medium transportation apparatus 26 will be described.

As shown in FIGS. 1 and 7, the medium transportation apparatus 16 and the medium transportation apparatus 26 include the roller pair 17 as the medium transportation portion for transporting the medium P; the first structure unit (the first plate member) 182 of the first guide portion 18 extending from the upstream side toward the downstream side in the medium transportation direction for guiding the medium P thus transported in the medium transportation direction; and the accommodation space 194 disposed on the upstream side of the first transportation path 181 formed with the first structure unit (the first plate member) 182 in the medium transportation direction for accommodating the transportation path length adjusting portion 186 or the transportation path length adjusting portion 186*a*, that is, the part of the first structure unit (the first plate member) 182, by an arbitrary length thereof within the range of the depth (the length in the x direction) of the accommodation space 194, respectively.

As described above, the first structure unit (the first plate member) 182 of the first guide portion 18 is arranged on the downstream side of the first member (the second structure unit) 192 of the second guide portion 19 in the medium transportation direction of the medium P, so that the accommodation space 194 is capable of accommodating the end portion of the first member (the second structure unit) 192 on the downstream side in the medium transportation direction.

In the third embodiment, the method is for assembling the medium transportation apparatus 16 and the medium transportation apparatus 26. As described above, the medium transportation apparatus 16 and the medium transportation apparatus 26 are disposed in the image forming apparatus 10 and the image forming apparatus 20, respectively. Further, the medium transportation apparatus 16 and the medium transportation apparatus 26 include the roller pair 17 for transporting the medium P; the first structure unit (the first plate member) 182 constituting the first transportation path 181 for guiding and transporting the medium P in the first direction (the −x direction) from the upstream side toward the downstream side in the medium transportation direction; and the first member (the second structure unit) 192 forming the accommodation space 194 for accommodating the part of the first structure unit (the first plate member) 182, respectively.

In the third embodiment, the method of assembling the medium transportation apparatus 16 and the medium transportation apparatus 26 includes the step of attaching the first member (the second structure unit) 192 to the main body structure portion 11 and the main body structure portion 21 of the image forming apparatus 10 and the image forming apparatus 20, respectively, so that the accommodation space 194 is formed. Further, the method includes the step of placing the first structure unit (the first plate member) 182, so that the first structure unit (the first plate member) 182 includes the transportation path forming portion 185 and the transportation path forming portion 185*a* as the first region disposed outside the accommodation space 194 and constituting the first transportation path 181, and the transportation path length adjusting portion 186 and the transportation path length adjusting portion 186*a* as the second region disposed inside the accommodation space 194 for adjusting the transportation path lengths L1 and L3 as the lengths of the transportation path forming portion 185 and the transportation path forming portion 185*a* in the first direction. Further, the method includes the step of adjusting the lengths of the transportation path forming portion 185 and the transportation path forming portion 185*a* in the first direction to set the transportation path lengths L1 and L3 of the transportation path forming portion 185 and the transportation path forming portion 185*a*. Further, the method includes the step of attaching the first structure unit (the first plate member) 182 to the main body structure portion 11 and the main body structure portion 21, respectively.

In the third embodiment, it is possible to adjust the lengths L2 and L4 of the first structure unit (the first plate member) 182 accommodated in the accommodation space 194 according to the types of the medium transportation apparatus 16 and the medium transportation apparatus 26 including the first structure unit (the first plate member) 182 and the accommodation space 194, or the types of the image forming apparatus 10 and the image forming apparatus 20.

In the third embodiment, as described above, the first structure unit (the first plate member) 182 of the first guide portion 18 is configured to be the common component capable of being used in the image forming apparatus 10 and the image forming apparatus 20, respectively. It should be noted that the length L2 of the first structure unit (the first plate member) 182 to be accommodated in the accommodation space 194 is greater than the length L4 of the transportation path length adjusting portion 186*a* of the image forming apparatus 20 in the first direction. Further, when the first structure unit (the first plate member) 182 is accommodated in the accommodation space 194, the part of the first structure unit (the first plate member) 182 accommodated in the accommodation space 194 is longer than 5% of the length (L0) of the first structure unit (the first plate member) 182 in the longitudinal direction thereof.

In the third embodiment, the method of assembling the medium transportation apparatus 16 and the medium transportation apparatus 26 is applicable to both the image forming apparatus 10 shown in FIG. 1 and the image forming apparatus 20 shown in FIG. 7.

In the third embodiment, the first structure unit (the first plate member) 182 can be communized among monochrome image forming apparatus or color image forming apparatus. Further, regardless of the types of the image forming apparatus, that is, the monochrome image forming apparatus or the color image forming apparatus, it is possible to communize the first structure unit (the first plate member) 182 for various image forming apparatus having different sizes, different types or different shapes.

Further, in the third embodiment, the image forming apparatus 10 or the image forming apparatus 20 includes one process unit, so that the toner image is directly transferred to the medium P. The present invention is not limited thereto, and may be applicable to an image processing apparatus for performing an image processing on a transported medium such as a color image forming apparatus using an intermediate transfer belt, a plural color image forming apparatus using a plurality of processing units, a copier using the image forming apparatus, or an automatic original reading apparatus.

In the first to third embodiments, the image forming apparatus 10 and the image forming apparatus 20 including the medium transportation apparatus 16 and the medium transportation apparatus 26 are explained as the example. It should be noted that, as far as the image forming apparatus includes the mechanism of forming the toner image or an ink image on the medium, the present invention is applicable to other apparatus such as a multifunction printer and a facsimile.

The disclosure of Japanese Patent Application No. 2014-091334, filed on Apr. 25, 2014, is incorporated in the application.

While the invention has been explained with reference to the specific embodiments of the invention, the explanation is illustrative and the invention is limited only by the appended claims.

What is claimed is:

1. A medium transportation apparatus, comprising:

a transportation portion transporting a medium;

a first structure unit defining a first transportation path that guides the medium in a first direction;

a second structure unit defining a second transportation path that guides the medium in a second direction toward the first structure unit, said second structure unit being disposed adjacent to the first structure unit; and an accommodation space disposed near the second structure unit to accommodate a part of the first structure unit, wherein said first structure unit includes a first region situated outside the accommodation space and where the medium is transported, and a second region situated inside the accommodation space and where the medium is not transported, said first region is situated on a downstream side of the second region in the first direction, said first structure unit includes a first roller holding portion and a second roller holding portion both capable of holding a roller to be rotatable, each of said first roller holding portion and said second roller holding portion includes a recessed portion capable of accommodating the roller and a bearing portion capable of supporting an axis of the roller, said first roller holding portion is situated in the first region and holds the roller, and said second roller holding portion is situated in the second region and does not hold the roller.

2. The medium transportation apparatus according to claim 1, wherein said second structure unit is configured so that the second transportation path inclines relative to the first transportation path.

3. The medium transportation apparatus according to claim 2, wherein said second structure unit is configured so that the second transportation path is curved, and said accommodation space is situated below the second transportation path in a vertical direction.

4. The medium transportation apparatus according to claim 3, wherein said second structure unit includes a transportation surface having a substantially C-character sectional shape viewed in a direction perpendicular to an imaginary plane in parallel to the first direction and the vertical direction, and said accommodation space is situated just below a downstream end portion of the transportation surface in the second direction.

5. The medium transportation apparatus according to claim 1, wherein said first structure unit is configured as a separate unit from the second structure unit.

6. The medium transportation apparatus according to claim 1, wherein said first structure unit is arranged so that a downstream end portion thereof in the first direction is accommodated in the accommodation space.

7. An image forming apparatus comprising the medium transportation apparatus according to claim 1.

8. The image forming apparatus according to claim 7, further comprising:

an image forming portion forming an image on the medium, wherein said medium transportation apparatus includes a medium reverse transportation portion for reversing the medium after the medium passes through the image forming portion, and for returning the medium to the image forming portion.

* * * * *